United States Patent [19]

Marcmann

[11] 4,163,347

[45] Aug. 7, 1979

[54] METHOD AND APPARATUS FOR SECURING INSULATION PANELS TO A STRUCTURE TO BE INSULATED THEREBY

[76] Inventor: Emil Marcmann, P.O. Box 5, Medford, N.J. 08055

[21] Appl. No.: 849,709

[22] Filed: Nov. 8, 1977

[51] Int. Cl.[2] ..... B65D 25/18; E04B 1/74

[52] U.S. Cl. ..... 52/105; 24/269; 52/127; 52/248; 52/741; 177/233; 220/437; 403/27; 403/166

[58] Field of Search ..... 220/435, 437, 440, 452, 220/444; 52/1, 127, 224, 248, 741, 105; 24/269, 71.2, 68 CD, 68 D; 254/161, 164; 403/166, 27; 177/233

[56] References Cited

U.S. PATENT DOCUMENTS

| | | | |
|---|---|---|---|
| Re. 27,330 | 4/1972 | Marcmann | 52/248 X |
| 1,408,955 | 5/1922 | Lopez | 403/166 X |
| 1,443,877 | 1/1923 | Guelbaum | 177/233 X |
| 1,458,014 | 6/1923 | Wailes | 177/233 |
| 1,910,116 | 5/1933 | Malleville | 24/269 UX |
| 2,323,297 | 7/1943 | Collins | 52/248 X |

FOREIGN PATENT DOCUMENTS

| | | | |
|---|---|---|---|
| 420830 | 5/1947 | Italy | 177/233 |

*Primary Examiner*—Alfred C. Perham
*Attorney, Agent, or Firm*—Frank P. Cyr

[57] ABSTRACT

A combined fastener and tension indicator means employed for securing the ends of a band having undulations formed therein. The band is employed for retaining insulation panels which have been applied over the exterior surface of a structure to be insulated thereby. The structure to be insulated is caused to expand and/or contract depending upon the surrounding atmospheric conditions. A tension is applied to the band to insure the band always being in close contact with the exterior surface of the structure to which the panels have been applied. The undulations formed in the band together with the amount of tension applied to the band will permit for the structure to which the panels have been applied to expand and/or contract while still retaining the insulation panels in close contact with the exterior surface of the structure to which the panels have been applied.

8 Claims, 12 Drawing Figures

METHOD AND APPARATUS FOR SECURING INSULATION PANELS TO A STRUCTURE TO BE INSULATED THEREBY

BACKGROUND OF THE INVENTION

In numerous industries but particularly in the petroleum industry, it is common to store liquids and the like within large tank structures which are usually installed out in the open where they will be exposed to the elements, and since such tank structures are usually constructed of steel or like metal, and being exposed to the elements, the metal will be caused to expand and/or contract depending upon the temperature conditions around the installation site of the tank. Similarly, conduits for the convenying of liquids or the like are oftentimes constructed of a metal, and here again, unless the conduit is well underground, below the frost line, the same is exposed to the elements and, here again, the conduit will be caused to expand and/or contract depending upon the temperature conditions thereabout. Cryogenic storage vessels must be insulated, and, here again, such storage vessels, when empty, the same are at ambient temperature whereas when a liquid is stored therein, with the temperature of such liquid being extremely low, the vessel will then contract and for this reason, it is imperative that provision be made to permit for such vessel to contract while still insuring that the insulating panels applied to the exterior surface thereof be kept in intimate contact therewith in order to properly insulate such vessels.

Numerous attempts have heretofore been made to insulate such metallic storage tanks, conduit and the like, which are used in the storage of liquids or for the transport of a liquid therethrough. For the most part, such attempts have fallen short of achieving the desired results for a number of reasons. First of all, it must be remembered that such storage tanks, conduits, and the like, are usually constructed of a suitable metal and since they are usually exposed to the elements, the same will expand and/or contract depending on the surrounding temperatures, as opposed to service temperatures. It must also be kept in mind that in order to insulate such exposed surfaces, it is imperative that the insulation materials be maintained in intimate contact with such exposed surfaces, as otherwise, the efficiency of the insulating material is greatly impaired.

Past attempts to secure insulating materials to a surface have considered adhesively securing the insulating material to the exposed surfaces but this manner of securing the insulating material is not feasible inasmuch as when the structure is caused to expand and/or contract by reason of the surrounding temperatures, the bond between the outer surface of the structure and the insulating material is broken thus causing a space between the exterior surface of the structure and the insulating material or causing breaks to occur in the insulating material, both such occurances greatly reducing the efficiency of the insulating material. Also, in the past, bolts have been fixedly secured to the outer surface of the structure and extend through the insulating material and cover sheet or facing sheet therefore and secured thereto in any known manner as by threading a nut or the like on the exposed threaded end of the bolt. Thus, with such an arrangment, no provision is made for permitting the insulating panel to respond to the expansion and/or contraction of the structures to which the insulating panels have been affixed with resultant separation of the insulating panels from the outer surface of the structure to which the panels have been applied.

With the above in mind, it is the primary object of the invention to apply insulating panels to the exterior surface of a structure to be insulated thereby and to retain such panels on such surface by employing a plurality of bands having undulations formed along substantially the entire length thereof, the band permitting the structure to which the panels have been applied to expand and/or contract depending upon the surrounding temperature conditions while still retaining the insulating panels in intimate contact with the structure to which the panels have been applied. Also, the bands provide a means whereby they will insure a constant intimate contact of the insulating panels with the exterior surface of the structure to which they have been applied and no only retain the panels in intimate contact with such exterior surface notwithstanding the expansion and/or contraction of the structure to which the panels have been applied, but also to retain the panels in their intimate contact with the structure notwithstanding high velocity winds directed thereagainst as during storms or the like.

Another object of the invention is to provide a novel manner of securing the edges of the insulating panels to the next adjacent panel to thus provide a means whereby the panels may, for any reason, be removed and readily replaced with a replacement panel.

Another object of the invention is to provide a novel means for securing the ends of the bands employed for retaining the insulation panels on the outer surface of a structure to be insulated thereby.

Another object of the invention is to provide a means at one edge of the insulating panel facing sheet whereby the retaining bands for the panels will be accommodated therein thus preventing vertical movement of the retaining bands once the same have been applied over the insulating panels.

Another object of the invention is to provide a visual means on the fastening members employed for securing the ends of the retaining bands whereby the amount of tension applied to the retaining bands may be readily determined.

Another object of the invention is to provide a simple yet efficient manner in which the tension applied to the retaining bands may be readily adjusted.

Another object of the invention is to employ a pawl and ratchet mechanism and a rotatable spool associated therewith whereby the band encircling the panels applied to the exterior surface to be insulated thereby can be adjusted relative thereto to thereby apply the required tension to the band to insure a constant intimate contact of the panels to the surface to which they have been applied.

These and other objects, features and advantages of the present invention will become more obvious from the following description when taken in connection with the accompanying drawings which show for purposes of illustration only, an installation of insulating panels to the outer surface of a storage tank.

DESCRIPTION OF THE PREFERRED EMBODIMENT

Figure 1:
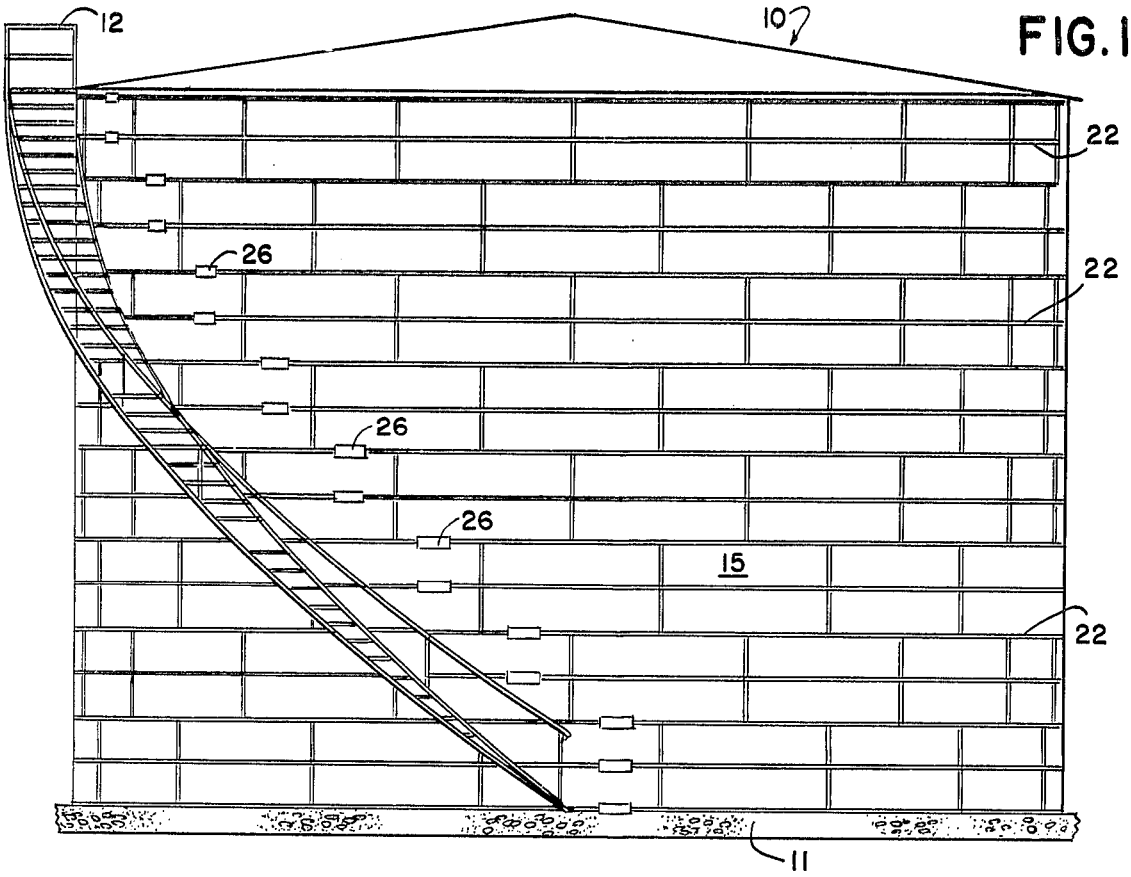
FIG. 1 is a perspective view of a storage tank showing the manner in which the insulation panels are mounted on the exterior surface thereof in staggered relationship with one another.

For purposes of illustration only, I have shown the manner of securing insulation panels to a storage tank such as is commonly employed in the storage of liquids in the petroleum industry, such tanks usually being erected on a concrete base and extend upwardly therefrom. However, it must be understood, the inventive concept described hereinafter can be equally and as effectively applied to a conduit, or for that matter, the inventive concept can be employed in securing insulation panels to any structure formed of metal or the like where such structure is subjected to expansion and/or contraction by reason of changes in the surrounding atmospheric temperatures.

Referring now to the drawings wherein like reference numerals are employed to designate like parts throughout the several views thereof, numeral 10 designates a conventional storage tank formed of a plurality of steel plates welded or otherwise secured together to form a cylindrical container usually in the area of some 50 feet in diameter and entending upwardly some 100 feet. The tank is erected on a suitable base 11 of concrete or the like. As is usual in such installations, a conventional stairway 12 is mounted in any known manner to the side of the tank to thus provide a means whereby the roof mounted instruents or the like may be periodically inspected. Also, the stairway 12 provides a means whereby the ends of the bands of the present invention may be secured to a fastener means after the insulating panels have been applied to the exterior surface of the storage container with the bands encircling the same and also to enable one to readily determine the amount of tension applied to the band.

Insulation panels employed for carrying out the objects of the present invention comprise a foamed plastic material 13 which is adhesively or otherwise secured to one face of a facing sheet 14 to form an insulation panel 15. The panels 15 are generally rectangular in shape although, obviously, the panels could be of some other shape, such as square, triangular, or the like, the only requirement as to the shape of the panels being that when the panels are arranged on the exterior surface of a structure to be insulated, the assembled panels will extend over all of the exterior surface of the structure to be insulated thereby. The face sheet 14 may be constructed of aluminum, steel, or the like, and the same may be coated with a suitable colored coating material so as to enhance the outward appearance of the installed panels.

Figure 2:
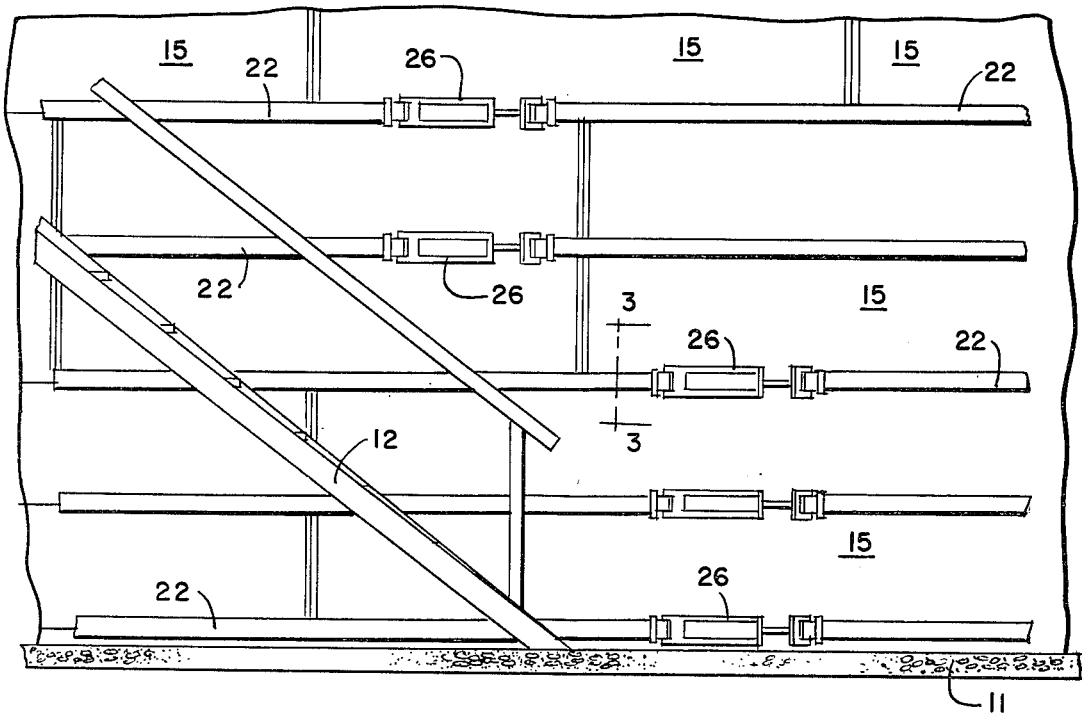
FIG. 2 is an enlarged section with parts broken away showing the manner in which the band ends and fasterner means are positioned along a stairway provided along one side of the storage container for easy access to inspect the amount of tension to the band with which the aforesaid fastener is associated.
Figure 6:
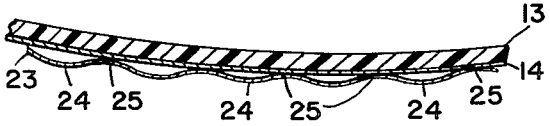
FIG. 6 is an enlarged sectional view showing the manner in which the securing band overlies the outer facing sheet of insulating panel.

As shown more particularly in FIGS. 1 and 2 of the drawings, a plurality of strap-like bands 22 are mounted exteriorly of the assembled panels 15 and encircle the structure to which the panels have been applied, and as shown in FIG. 6 of the drawings, the bands are provided with a plurality of undulations and the bands are constructed of a material capable of being elastically deformed without causing any permanent deformation. Such material can be heat-treated spring steel although materials having similar characteristics can be employed in the formation of the bands, such as synthetic plastics, aluminum alloys, etc. As best seen in FIG. 6 of the drawings, under normal conditions, the high portions 24 of the undulations are out of contact with the face sheet 14 whereas the valleys 25 extending between the high portions 24 are in contact with the face sheet and exert a pressure thereon to maintain the insulation material 13 in close contact with the exterior surface of the structure to which the panels have been applied. The width, length, as well as the thickness of the bands will vary depending on the size or diameter of the structure to which the panels are to be applied. Also, the material employed in the formation of the bands will have the required tensile strength to withstand the forces applied thereto in a manner to be described more fully hereinafter.

Figure 3:
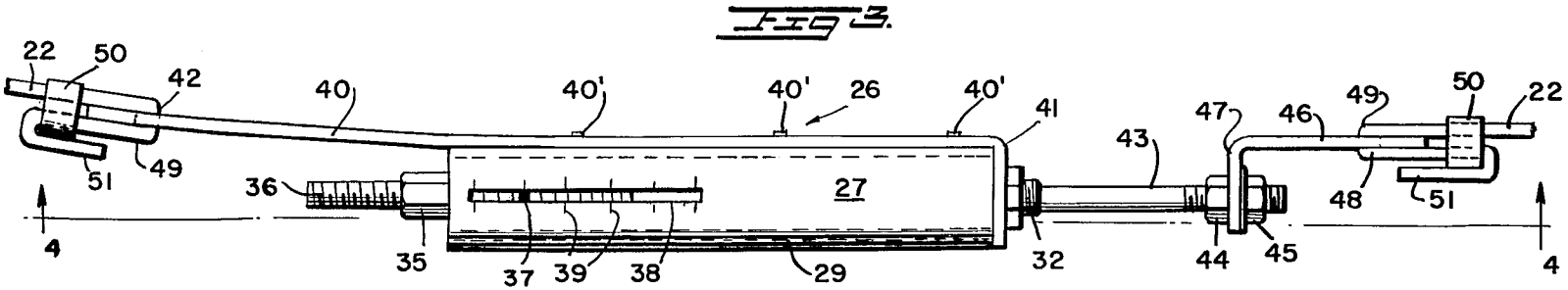
FIG. 3 is an enlarged view taken on lines 3—3 of FIG. 2, looking in the direction of the arrows.
Figure 4:
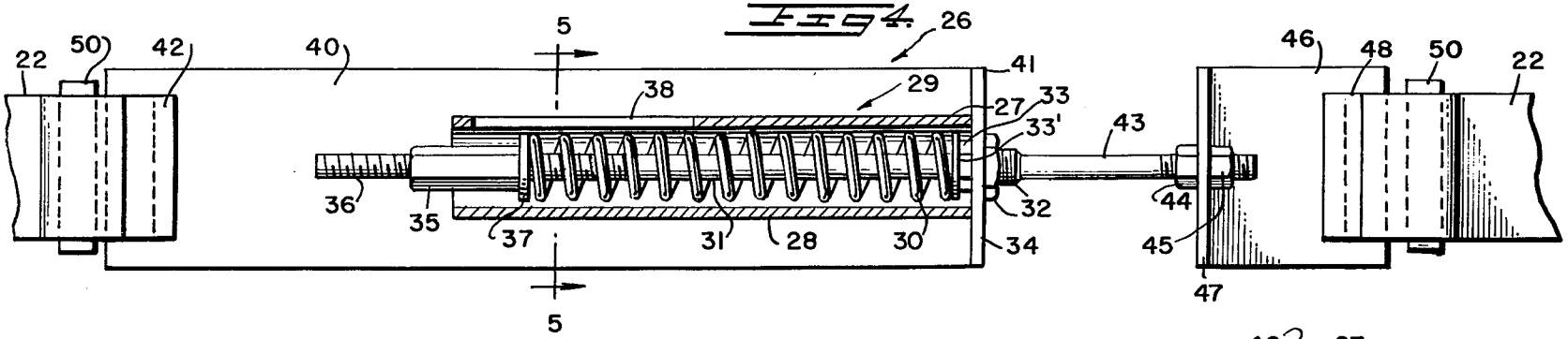
FIG. 4 is an enlarged front elevation taken on lines 4—4 of FIG. 3, looking in the direction of the arrows.
Figure 5:
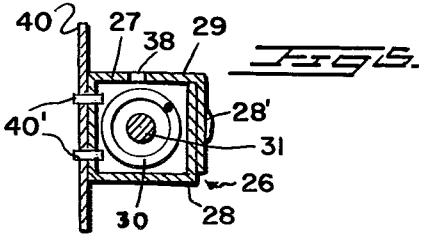
FIG. 5 is a section taken on lines 5—5 of FIG. 4, looking in the direction of the arrows.

Referring now more particularly to FIGS. 3, 4 and 5 of the drawings, there is shown therein the fastener 26 employed for securing the ends of the bands together. The fastener 26 serves not only to secure the ends of the bands together but also serves as a means whereby a tension may be applied to the bands in a manner to be described later. The fastener 26 comprises a pair of L-shaped members 27, 28, welded or otherwise secured to one another to form a housing 29 for a spring 30 mounted therein. If desired, the L-shaped members may be secured to each other as by rivets 28'. A rod 31 extends through the housing 29 and is affixed thereto at one end thereof by a bulkhead bushing 33 and a lock nut 32 which abuts one end wall 34 of the housing as shown more clearly in FIG. 4 of the drawings. One end of the spring 30 abuts against the washer 33' seated on the bulkhead bushing 33 and the opposite end of the spring is engaged by an adjustment nut 35 threadedly mounted on the externally threaded portion 36 of the rod 31. Mounted intermediate the adjustment nut 35 and the spring 30 shown in FIGS. 3 and 4 of the drawings is a tension indicator 37 which is mounted for sliding movement on the rod 31 when the tension of the spring 30 is adjusted by means of the adjustment nut 35. L-shaped member 27 is provided with a slot 38 and graduations 39 are formed along the slot so as to give a visual indication of the amount of tension applied to the spring 30. The tension indicator may be in the nature of a washer or the like 37 mounted for sliding movement on the rod 31 and may be colored so as to enable one viewing the same through the slot 38 formed in the housing 29 to readily determine its position within the housing thus indicating the amount of tension applied to the band.

A mounting anchor plate 40 comprising a flat plate-like member is provided at one end thereof with a bent portion 41 having an opening therein through which the rod 31 extends and the anchor plate is secured to the housing by means of rivets 40'. The opposite end of the anchor plate 40 is provided with a slot 42 for securing one end of the band 22 in a manner to be described more fully hereinafter. Formed integral with the rod 31 is an extension 43 to which is secured as by nuts 44, 45 to a strap-like member 46 provided at one end thereof with a bent portion 47 having an opening formed therein through which the rod 31 extends and the strap 46 is secured thereto by means of the aforesaid nuts 44, 45. A slot 48 is formed in the strap 46 for securing the end of the band to the fastener assembly 26.

Each of the band ends are secured to the fastener assembly in the same manner. One end of the strap is inserted into the slot 42 and then bent rearwardly as at 49. Then, a band back loop 50 in the nature of a flat encircling band is placed over the band and reversely bent portion 49 and following this, the band end is again reversely bent as at 51 to complete the fastening of that end of the band to the fastener assembly 26. The opposite end of the band is similarly secured to the strap member 46, that is, the band end is inserted in slot 48 then bent rearwardly, a band back loop 50 is placed over the band and rearwardly bent portion and then the end of the band is again bent as at 51 to complete the fastening of the band end to that portion of the fastener assembly.

Figure 7:
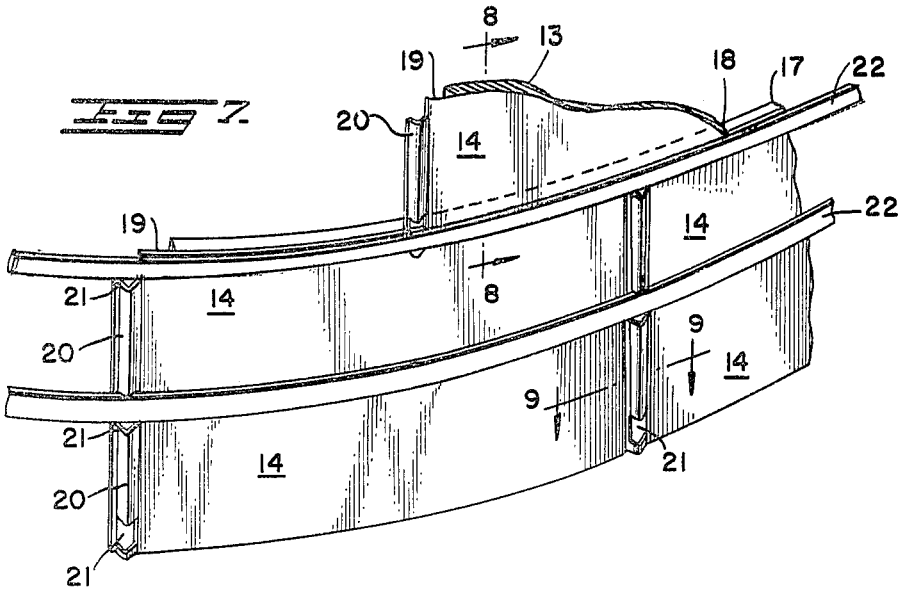
FIG. 7 is an enlarged sectional view showing the manner in which the edges of the insulating panel are arranged in overlapped relationship with one another.
Figure 8:
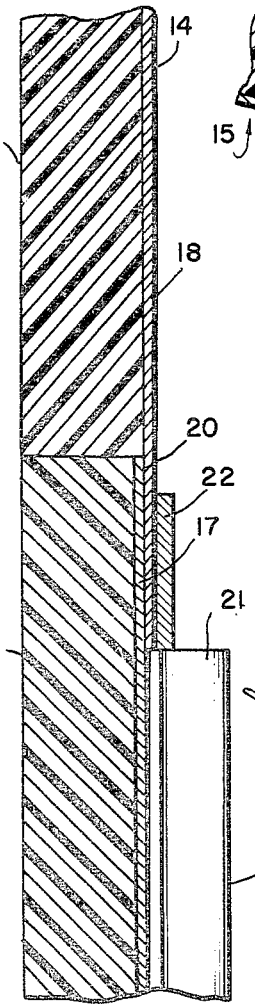
FIG. 8 is a section taken on lines 8—8 of FIG. 7, looking in the direction of the arrows.
Figure 9:
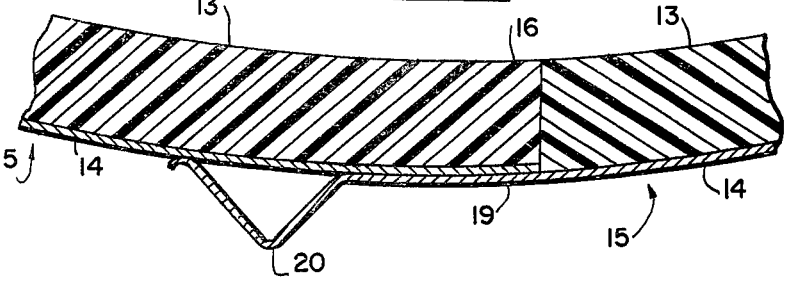
FIG. 9 is a sectional view taken on lines 9—9 of FIG. 7, looking in the direction of the arrows.
Figure 10:
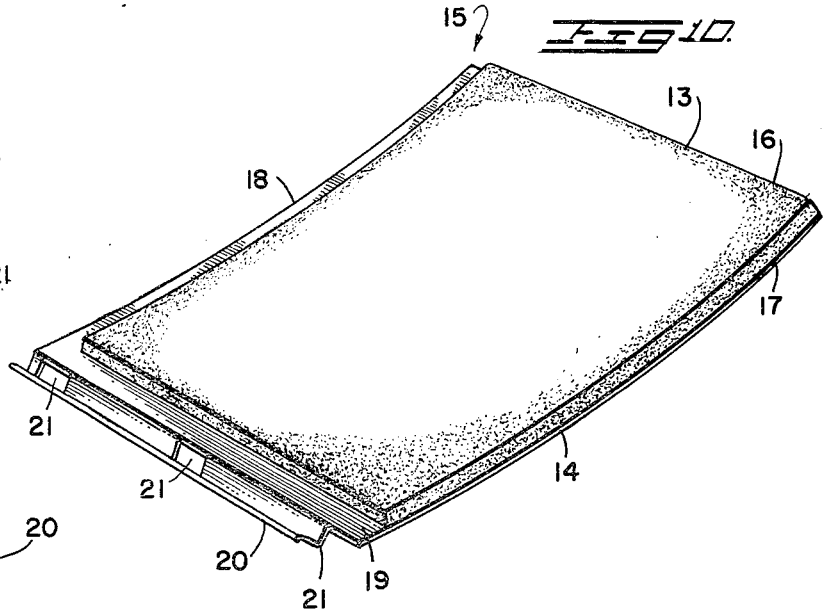
FIG. 10 is a perspective view showing the structure of one of the insulating panels.

To assemble the insulating panels to a structure to be insulated thereby, a first bottom row of horizontally extending panels are arranged in a side by side relationship with the edge of the panel having the upstanding flange 20 thereon overlying the face sheet 14 of the next adjacent panel as shown more clearly in FIG. 9 of the drawings. Following assembly of the panels in the manner aforesaid, a first band is applied over the assembled panels with the band positioned in one of the cut-outs 21 provided in each of the upstanding flanges 20. When the band has completely encircled the panels the band ends are then secured to the fastener assembly in the manner set forth above. Having secured the first row of horizontally extending panels to the structure to be insulated thereby, a next horizontally extending row of panels is assembled in the manner set forth above only in this case, the next row of panels is staggered with respect to the said first row of panels as shown more clearly in FIG. 7 of the drawings and with the lower side 18 of the face sheet 14 overlapping the side 17 of the next adjacent lower row of panels as shown more clearly in FIG. 8 of the drawings. Following assembly of the said next row of panels in the manner aforesaid, the bands are again employed for securing the panels to the structure to be insulated. This procedure is repeated until all of the panels have been secured to the structure to be insulated thereby. It will be noted that the uppermost cut-out 21 formed on the flange 20 will receive therein the lower edge of the face sheet when the panels are assembled. Having installed the panels in the manner aforesaid, the cut-outs will prevent any vertical movement of the bands on the assembly.

Thus, it will be seen that by virtue of the arrangement of the foam material on the face sheet, the face sheets of one panel is in overlapped relationship with respect to the face sheet of the next adjacent panel. Since the panels 15 are retained on the insulated structure solely by means of the encircling bands, it is obvious that by the removal of the bands extending over the panels that any one or more of the panels in a given row may be removed and replaced whenever necessary.

Figure 11:
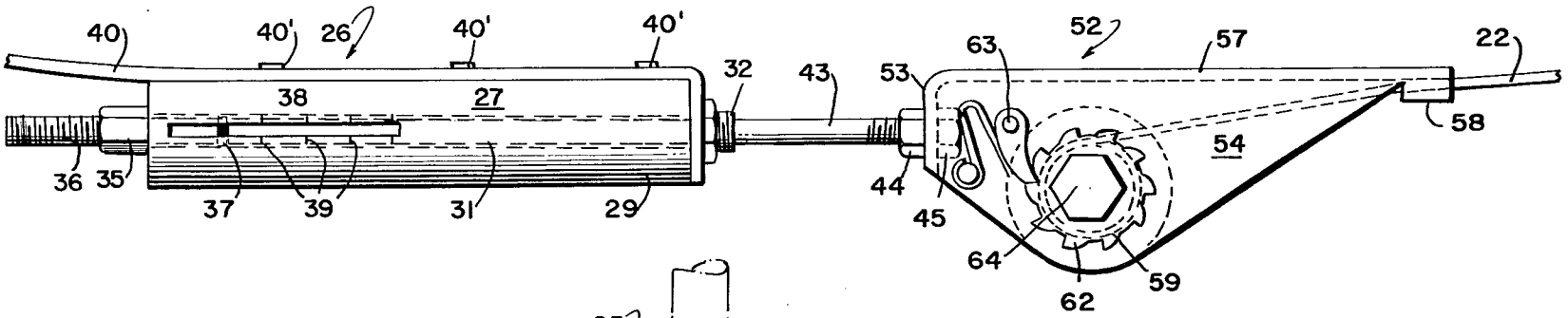
FIG. 11 is an enlarged top elevation of a modification of the invention.
Figure 12:
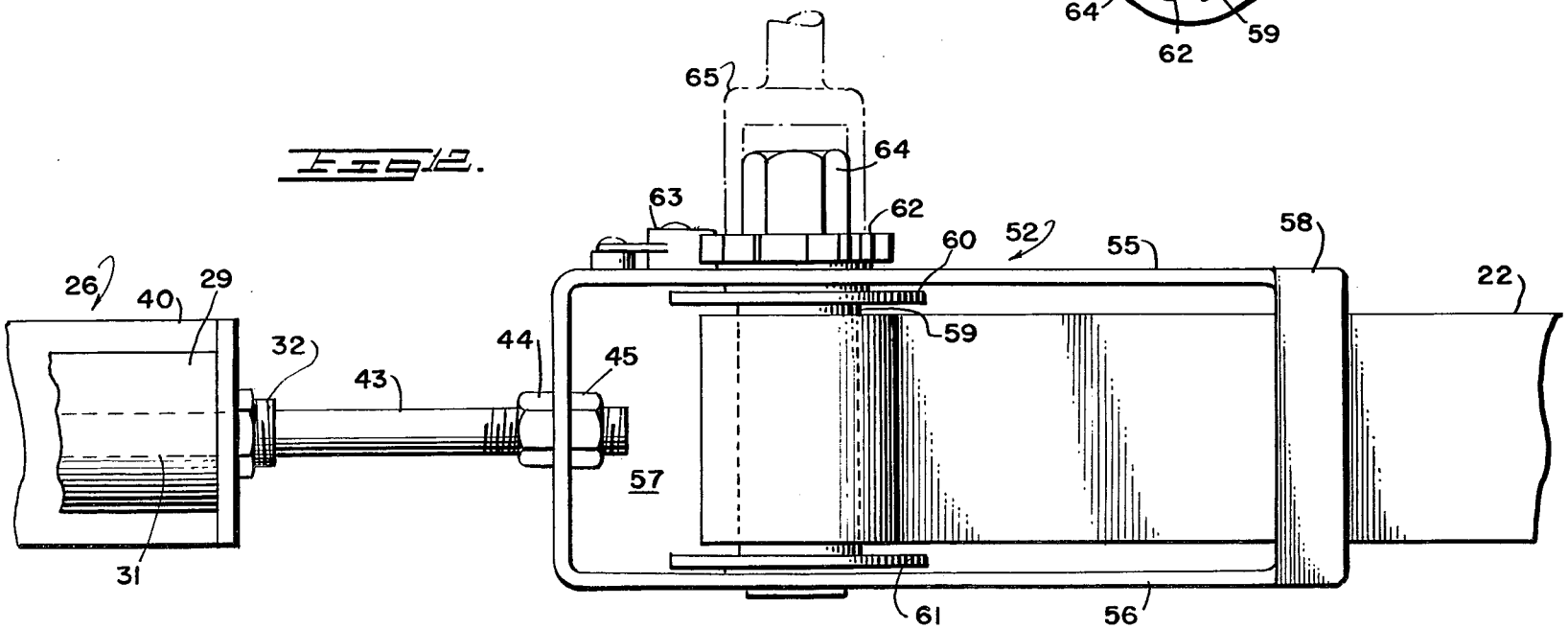
FIG. 12 is an enlarged front view of the structure shown in FIG. 11.

As stated previously, normally the valleys 25 between the undulations formed on the bands 22 are in contact with the face sheet of the panels and exert a force thereon to keep the insulation in intimate contact with the surface to which the panel has been applied. However, in order to insure a continued application of force on the face sheet of the panels, the spring 30 can be compressed within the housing by tightening the adjustment nut 35 on rod 31, or on large structures to be insulated in the manner previously described, a pawl, ratchet and spool assembly such as shown in FIGS. 11 and 12 of the drawings may be employed. The structure shown in FIGS. 11 and 12 of the drawings will be described with more particularity hereinafter. The application of a tension force on the bands through the aforesaid spring or spool will insure a constant force being exerted on the face sheet of the panel. Should the structure to which the panels have been applied contract due to temperature conditions, the band valleys will still be in contact with the face sheets and exert a force thereon by reason of the formation of the undulations on the band which, as set forth previously, will provide elasticity to the band and when such contraction occurs, the undulations having been placed under tension by reason of the tension spring, as aforesaid, will tend to return to their original configuration, thus still applying a force to the face sheets of the panels.

The amount of tension to be applied to the bands will be determined prior to installation of the panels, and following installation of the panels, as aforesaid, the tension can then be set at the predetermined setting which can be accomplished by visual inspection of the tension indicator on the housing for the tension spring.

Shown in FIGS. 11 and 12 of the drawings is a modification disclosing another manner wherein the tension applied to the bands may be adjusted. Shown in these figures of the drawings is a pawl and ratchet assembly 52. In this modification of the invention, the anchor plate 40 is secured to the L-shaped member 27 by means of rivets 40' and the rod 31 and extension 43 are secured to the pawl and ratchet assembly by means of nuts 44, 45 provided on either side of an L-shaped member 53 provided at one end of the housing 54. The housing 54 comprises a pair of spaced apart parallel sideplates 55, 56, top wall 54 and the aforesaid L-shaped member 53. A strap 58 extends between sidewalls 55,56 and is spaced from the top wall 57 to provide an opening through which the band extends as shown more clearly in FIGS. 11 and 12 of the drawings. Mounted for rotation between the aforesaid sidewalls 55, 56 is a spool 59 provided with a means thereon whereby the end of the band 22 may be secured thereto. A pair of washers 60, 61 are provided on both sides of the spool 59 and a ratchet 62 is fixed to the spool shaft (not shown) for rotation with the aforesaid spool when the same is rotated to apply or release a tension applied to the band 22 with which it is associated. A spring pressed pawl 63 is mounted on the sidewall 55 and a nut 64 is fixedly mounted on the spool shaft (not shown).

Unlike the structure shown in FIGS. 1 to 10 inclusive of the drawings wherein a rod 31 is prevented from outward movement from within the housing 29 by reason of the bulkhead bushing 33 abutting the end wall 34, the rod 31 shown in FIGS. 11 and 12 of the drawings is capable of being pulled outwardly of the housing 29 when a pulling force is applied thereto as by rotation of the aforesaid spool 59. The lock nut 32 shown in FIGS. 11 and 12 of the drawings, however, limit the inward movement of the rod 31 and extension 43 into the aforesaid housing 29. A tension indicator 37 is fixedly mounted on the rod 31 and a sight opening slot 38 is provided in the housing and graduations 39 are formed along side of the slot to indicate the amount of tension applied to the band 22. In use, one end of the band 22 is secured to the anchor plate 40 in the manner previously described and the other end of the band is secured in any known manner to the aforesaid spool 59. Rotation of the spool by means of a wrench 65 will effect a tightening or loosening of the band and likewise the tension which has been applied to the panels maintained on the exterior surface of the structure to be insulated thereby and the amount of tension applied to the band may be readily determined by noting the position of the tension indicator within the housing 29 through the aforesaid slot 38.

Thus, it will be seen that I have provided a simple yet efficient manner in which insulation panels which have been applied to the exterior surface of a structure to be insulated thereby are kept in constant intimate contact therewith notwithstanding the expansion or contraction of such structure due to the conditions described previously. As can be appreciated, the insulation panels of the present invention are not fixedly secured to the structure to which they have been applied but rather the same are capable of movement along the surface to which they have been applied while still retaining an intimate surface contact with the structure to thereby insure a constant insulation of the structures which is most important, particularly in the storage or transportation of liquids or fluids which, due to temperature changes, will cause the storage container to expand or contract responsive to such temperature changes.

The formation of the bands with the undulations therein used in this environment is a great improvement in the art insofar as refers to insulating structures which are subjected to expansion and/or contraction to which insulation panels have been applied to the exterior surface thereof and that the particular manner of insuring a constant intimate contact of the panels to the structure in a manner taught by the instant invention is a considerable improvement over the prior methods and apparatus employed in attempting to insulate structures which are caused to expand and/or contract due to surrounding temperature conditions.

While I have shown and described the most preferred embodiment of the present invention, it is understood that the same is not limited thereto but is susceptible of numerous changes and modifications as known to a person skilled in the art and I therefore do not wish to be limited to the details shown and described herein, but intend to cover all such changes and modifications as are known to a person skilled in this art.

I claim:

1. In a method of retaining insulating panels in close intimate contact with the exterior surface to which the panels have been applied and wherein said structure is subjected to expansion and contraction due to atmospheric conditions surrounding said structure, the improvement comprising retaining said panels against the outer surface of said structure by means of an encircling band having undulations formed therein throughout substantially the length thereof with the ends of the said band sucured to a spring loaded fastener and tension indicator means, said undulated band enabling said structure to expand and contract dependent upon surrounding atmospheric conditions while still retaining said panels in close intimate contact with the outer surface of the structure to which they have been applied.

2. The method recited in claim 1 wherein said panels are arranged in horizontally extending rows on said structure and wherein the next adjacent row of panels placed on said structure is in staggered relationship with respect to a previously arranged row of panels.

3. The method recited in claim 1 wherein the tension on the bands may be varied to compensate for the expansion and contraction of the structure to which they have been applied depending upon the varying temperature conditions surrounding said structure.

4. A combined fastener and tension indicator means for maintaining an undulated band in constant contact with the exterior surface of insulation panels which have been applied to the exterior surface of the structure to be insulated thereby and wherein said structure is subjected to expansion and contraction depending upon the atmospheric conditions, the improvement comprising said band provided with a plurality of undulations formed therein to thus present high portions and valleys therebetween, the ends of said band being secured to a fastener and tension indicator, means on said fastener and tension indicator to vary the amount of tension applied to said band the tension applied to said band causing said valleys to remain in constant contact with the exterior surface of the said panels and to exert a force thereon to thus maintain said insulation panels in close contact with the exterior surface of the structure to which the panels have been applied notwithstanding the expansion and contraction of the said structure.

5. The structure recited in claim 4 wherein a tension spring is housed is said fastener and tension indicator means.

6. The structure recited in claim 4 wherein a pawl and ratchet and rotatable spool assembly is employed to vary the amount of tension applied to the said band through the aforesaid spring.

7. The structure recited in claim 4 wherein said combined fastener and tension indicator is mounted on an anchor plate engaging with the outer surface of the structure to which the insulating panels are applied, said anchor plate having an opening formed therein to receive one end of the said band with means to secure said band to said anchor plate, an extension adjustably secured to said fastener and tension indicator at the other end of said anchor plate to which the other end of said band is secured.

8. A combined fastener and tension indicator means for maintaining a band having undulations formed therein in constant contact with the exterior surface of insulation panels which have been applied to the exterior surface of a structure to be insulated thereby, said structure expanding and contracting depending upon the surrounding atmospheric conditions, said fastener and tension indicator comprising a housing having an anchor plate fixed thereto with means at one end thereof for securing said band thereto, an externally threaded rod extending through said housing, a spring encircling said rod and an adjustment nut mounted on said threaded rod and abutting one end of said spring, the other end of said spring abutting a bulkhead bushing on said housing, said rod extending beyond said housing and secured to an anchor plate, said anchor plate provided with means whereby the other end of said band is secured to said anchor plate, said housing provided with a slot therein whereby the amount of tension applied to the said band can be ascertained.

* * * * *